United States Patent [19]

Kerr, III et al.

[11] 4,144,557

[45] Mar. 13, 1979

[54] EL FLASHLIGHT

[75] Inventors: Charles Kerr, III; Daniel V. Krause, both of East Aurora, N.Y.

[73] Assignee: Astronics Corporation, East Aurora, N.Y.

[21] Appl. No.: 834,393

[22] Filed: Sep. 19, 1977

[51] Int. Cl.[2] ..... F21V 9/16

[52] U.S. Cl. ..... 362/84; 362/157; 362/158; 362/202; 362/208

[58] Field of Search ..... 362/84, 158, 157, 202–206, 362/208

[56] References Cited

U.S. PATENT DOCUMENTS 3,461,346 8/1969 Lilly ..... 362/157 X

*Primary Examiner*—Stephen J. Lechert, Jr.

*Attorney, Agent, or Firm*—Shlesinger, Fitzsimmons & Shlesinger

[57] ABSTRACT

A flat, disc-shaped EL lamp is removably mounted in the head of a conventional flashlight casing between the usual transparent lens and the bowl-shaped metal housing, which usually forms the reflector for a flashlight bulb. In this case, however, a converter circuit is potted in the housing and includes a spring contact, which projects from the front of the housing into resilient contact with a foil disc secured to the back of the EL lamp. The foil disc is connected to the back electrode of the lamp, and the front electrode is connected to a metal rivet which is seated against the periphery of the metal housing. When the switch on the flashlight is moved to its ON position, DC power from the batteries is converted by the potted circuit to an AC signal which is applied to the EL lamp electrodes to make the lamp glow.

11 Claims, 4 Drawing Figures

EL FLASHLIGHT

This invention relates to flashlights, and more particularly to a novel flashlight which utilizes an electroluminescent lamp for producing illumination, rather than the usual incandescent flashlight bulb.

Most conventional flashlights employ an incandescent, filament-type bulb to produce illumination. This type of bulb projects a generally cone-shaped beam of light which is visible when viewed from the side or transversely of the beam. Moreover, since most conventional flashlights are powered by small dry cell batteries, the intensity of the beam of light diminishes quite rapidly with the power of the batteries.

In contrast, the illumination produced by an EL (electroluminescent) lamp or panel does not project a beam of light which is viewable from the side thereof; and the power required for illuminating such an EL lamp is so small, as compared to that required for the conventional flashlight, that decay in its power supply does not have as correspondingly a drastic effect in the illumination of the EL lamp, as compared to that of the conventional flashlight bulb.

Still another advantage of an EL lamp, as compared to the conventional incandescent lamp, is that it is possible in the case of the EL lamp readily to provide a narrow wavelength output, which will not damage conventional light-sensitive photographic film. This makes the EL lamp particularly suitable for use where low level illumination is necessary, as for instance in photographic dark rooms. In such rooms, of course, it is particularly advantageous to have low level portable illumination, rather than fixed or stationary lamps, so that the overall environmental light need not be as intense.

It is an object of this invention, therefore, to provide a novel EL flashlight, which is particularly suited for use in dark rooms and similar areas where conventional incandescent illumination is unsatisfactory.

Still another object of this invention is to provide a relatively small, portable EL lamp, which can be powered by conventional flashlight batteries or the like, and which requires extremely low power consumption.

A further object of this invention is to provide a novel EL flashlight having a relatively inexpensive, compact circuit for converting a DC battery voltage to an intermittent signal for illuminating the lamp.

Another object of this invention is to provide a novel EL lamp which is particularly suited for substitution in a conventional flashlight in place of the incandescent lamp normally used in such light.

Other objects of the invention will be apparent hereinafter from the specification and from the recital of the appended claims, particularly when read in conjunction with the accompanying drawings:

Figure 1:
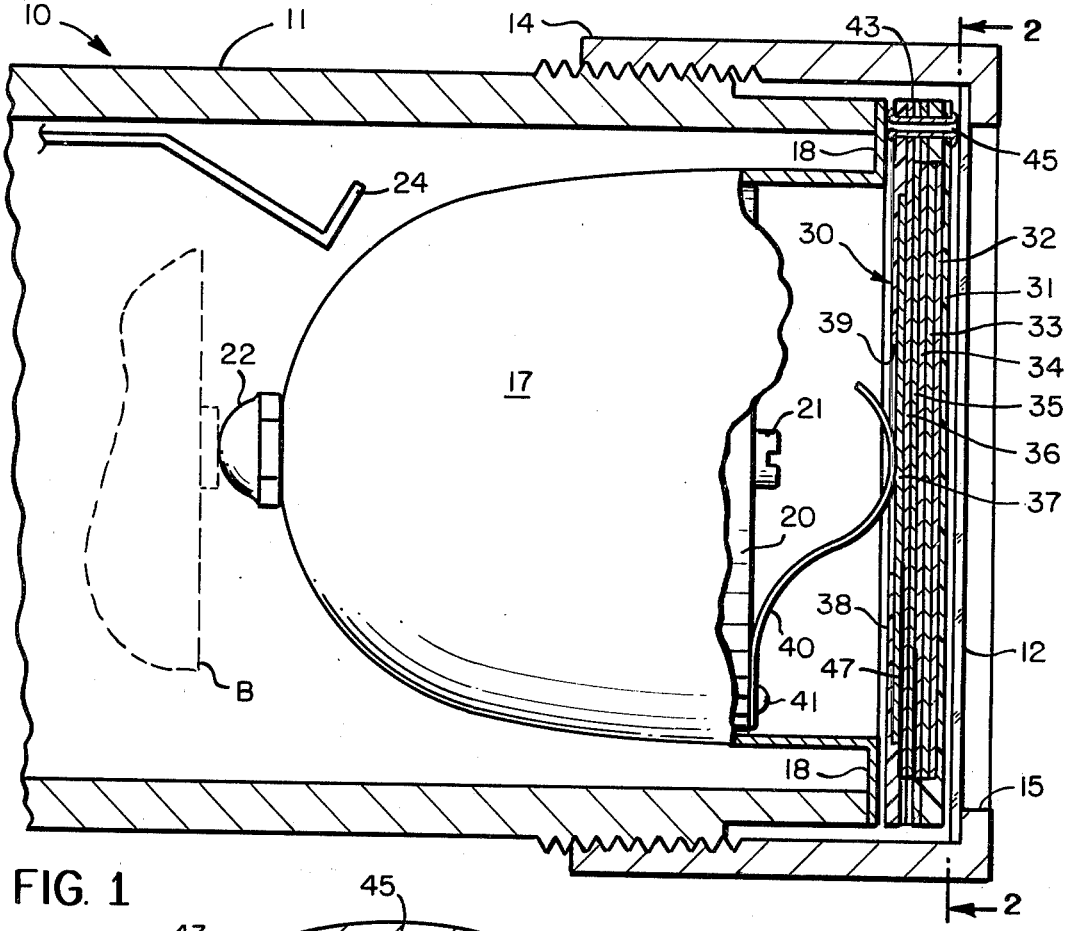
FIG. 1 is a fragmentary axial section view taken through one end of an EL flashlight made according to one embodiment of this invention, portions of the flashlight being shown in full, and other portions being broken away in part for purposes of illustration.
Figure 2:
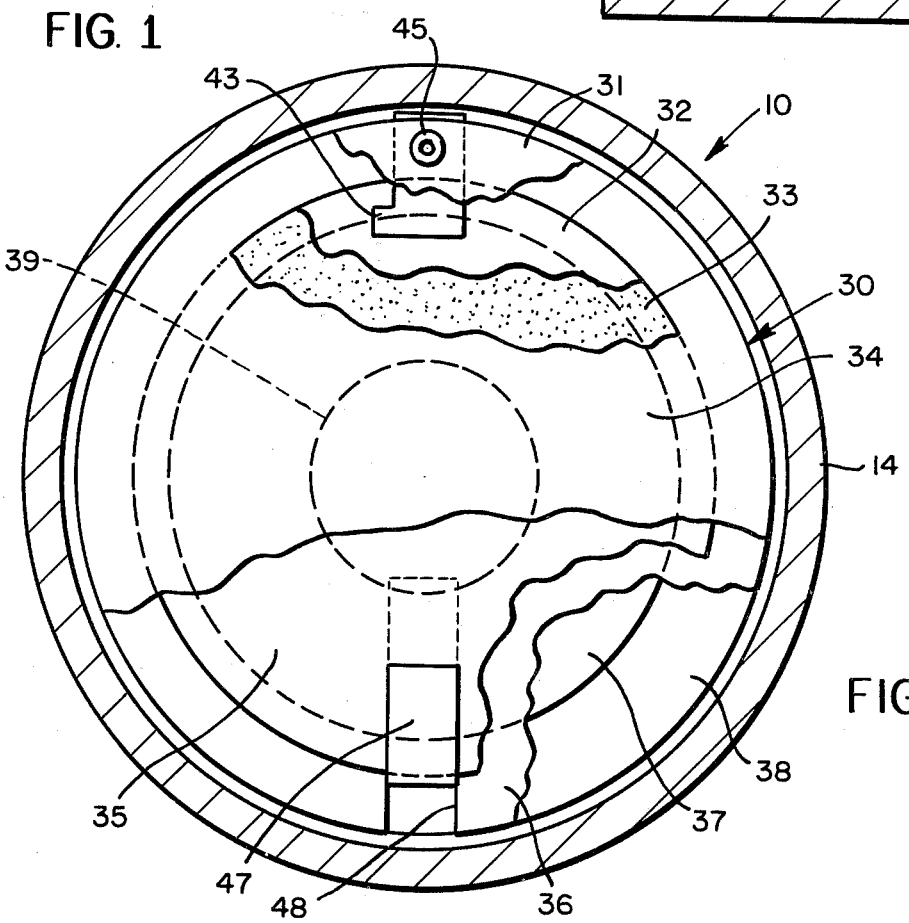
FIG. 2 is a fragmentary sectional view taken along the line 2—2 in FIG. 1 looking in the direction of the arrows, portions of the flashlight again being cut away for purposes of illustration.

Referring now to the drawings by numerals of reference, and first to FIGS. 1 and 2, 10 denotes generally an EL flashlight comprising a conventional, tubular flashlight housing 11, and a transparent, disc-shaped lens 12, which is removably secured over the light-emitting end of housing 11 by a conventional, bezel-type end cap 14. Cap 14, which is generally annular in configuration, threads at one end onto the light-emitting end of housing 11, and has on its opposite end a radially inwardly projecting annular flange 15 against which the lens 12 is seated coaxially of housing 11. Housing 11 and its end cap 14 may be made from a plastic material; and the lens 12 may be made from glass or a transparent plastic material.

Removably mounted in the open, light-emitting end of the housing 11 coaxially thereof, and in radially spaced relation to its inner bore wall, is a generally bowl-shaped housing 17, which is similar in configuration to the conventional bowl-shaped reflector that forms part of most conventional flashlights. Around its open end, which faces lens 12, housing 17 has a circumferential support flange 18, which overlies the terminal edge of housing 11 at its light-emitting end.

Secured in the housing 17 by potting material 20 and a screw 21 is an electrical circuit, the details of which will be described hereinafter. Screw 21 has a shank which extends centrally through the potting material 20 and the bottom of housing 17, where a cap nut 22 is secured over the terminal end thereof. As noted hereinafter, the nut 22 is connected to the circuit which is potted in the housing 17, and is engageable with one end of one of the batteries B, which are enclosed in housing 11 in the usual manner to provide a DC power supply for the flashlight 10.

As shown in FIG. 1 the rounded, closed end of housing 17 is also located in registry with, for example, one end of the manually-operable switch contact 24, which is mounted in known manner on the housing 11 for manipulation into and out of engagement with the bottom of housing 17, thereby selectively to supply power through the battery B to the nut 22, and consequently to the circuit in housing 17.

Also removably mounted over the light-emitting end of housing 11 between the circuit in housing 17 and the lens 12 is a novel, generally disc-shaped EL lamp, which is denoted generally by the numeral 30.

Lamp 30 comprises a transparent, disc-shaped front electrode 32, the face of which is positioned sealingly and coaxially against a transparent front cover layer 31 of plastic material. Layer 31 also is disc-shaped in configuration, but is slightly larger in diameter than the electrode 32. The back of electrode 32 is coated with a layer 33 of electroluminescent material, and this layer is in turn covered by a layer 34 of plastic, dielectric material, which may be similar in configuration to the EL material 33. Secured to the back of the dielectric layer 34 is the rear electrode 35, which is a thin layer of electrically-conductive material similar in configuration to, and which registers coaxially with, the front electrode 32. The back electrode 35 is covered with a disc-shaped layer 36 of plastic, dielectric material, which is of the same diameter as the front cover layer 31, and which has its marginal edges sealingly secured thereto.

Secured to the back of the insulating layer 36 coaxially thereof is a disc-shaped layer 37 of metal foil, which has a diameter slightly less than the diameter of the electrodes 32 and 35. Secured to the back of the foil layer 37 is still another layer 38 of plastic insulating material which is similar in configuration to the insulation layers 31 and 36, and which also is sealingly secured around its marginal edges to layer 36. The back insulation layer 38, however, has in the center thereof a large circular opening 39, which has a diameter smaller than that of the foil disc 37.

When the lamp 30 is secured in the housing 11 as shown in FIG. 1, the opening 39 in the insulation layer 38 enables the foil disc 37 to be engaged with one end of a spring contact 40, the opposite end of which is secured by a screw or rivet 41 to the potted circuit in the housing 17 for a purpose to be noted hereinafter.

In order to supply power to the electrodes in lamp 30 a thin metal lead 43 has one end thereof secured to the face of the front electrode 32 beneath the front insulation layer 31, and projects at its opposite end outwardly beyond the sealed insulation layers 31 and 34, where it is folded rearwardly to extend downwardly, as shown in FIG. 1, behind the outside surface of the back insulation layer 38. The rear or trailing end of the metal lead 43 is secured beneath one end of a metal rivet 45, which extends completely through the numerous layers forming lamp 30, and which has its opposite end peaned over against the outside surface of the front insulation layer 31. The lead 43 thus electrically connects the front electrode 32 to the rivet 45; and as shown in FIG. 1, the rear end of rivet 45 engages the flange 18 on the housing 17, when the flashlight is assembled, so that the metal housing 17 is thereby connected electrically to the front electrode 32.

Another thin metal lead 47 has one end thereof secured to the face of the back electrode 35, between electrode 35 and the insulation 34. At its opposite end lead 47 extends outwardly over the peripheral edge of the rear electrode 35, and then is folded rearwardly (upwardly as shown in FIG. 1) into engagement with the front face of the foil disc 37, between disc 37 and the insulation layer 36. In the illustrated embodiment the layer 36 is notched as at 48 (FIG. 2) in its periphery to allow the trailing end of the lead 47 to be folded back without having to project outwardly beyond the outer peripheral edges of the insulating layers 31 and 36, as in the case of lead 43. Lead 47 thereby electrically connects the back electrode 35 through the foil disc 37 to the spring contact 40 for a purpose noted hereinafter.

During its manufacture, it will be understood that the overlapping portions of the insulation layer 31, 34, 36 and 38 are pressed into sealing engagement by heat and pressure, so that the electrodes and the EL material in lamp 30 are completely sealed within the lamp. Moreover, while the rear electrode 35 can be made of a metal foil material, the front electrode 32 must be made from transparent or translucent material, so that when the EL material 33 is energized and becomes excited, the resultant illumination will pass outwardly through electrode 32, the covering layer 31, and the transparent lens 12.

Figure 3:
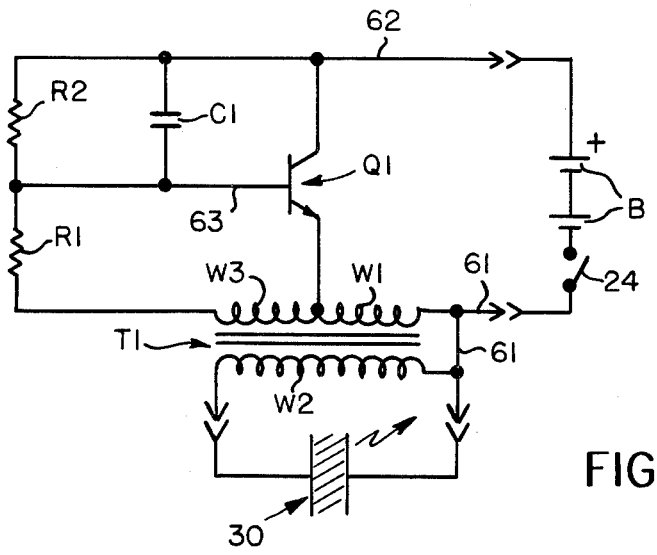
FIG. 3 is a schematic wiring diagram showing one type of oscillator circuit which may be employed for converting the DC power supply of conventional flashlight batteries into an AC signal for steady energization of the EL lamp shown in FIGS. 1 and 2.

Referring now to FIG. 3, wherein like numerals are employed to denote elements similar to those employed in FIGS. 1 and 2, the letter B denotes a DC power supply, such as two flashlight batteries which are adapted to be removably mounted in the housing 11. The EL lamp 30 is connected in parallel with the secondary winding W2 of a transformer T1. Conductor 61 connects one side of the lamp 30 and one end of winding W2 selectively through switch 24 with the negative terminal of the power supply B, and also with one end of the primary winding W1 of the transformer. The opposite end of winding W1 is connected in series through resistors R1 and R2 and conductor 62 with the positive terminal of power supply B. A gain element in the form of transistor Q1 has its emitter connected to winding W1 intermediate its ends, and its collector terminal connected to conductor 62. The base of transistor Q1 is connected by a conductor 63 to the common or interconnected ends of resistors R1 and R2. A capacitor C1 is connected in parallel with resistor R2 between conductors 62 and 63.

When switch 24 is closed the capacitor C1 is not charged, and its charging current flows through the base of Q1 to bias the transistor to its conducting mode, whereby current begins to flow through its collector-emitter circuit and the primary winding W1 to generate current flow in one direction in the secondary W2. Portion W3 of winding W1 functions as the feedback winding in which a positive feedback signal is generated during the increase in the collector-emitter current of Q1. When saturation is reached, the induced positive feedback signal ceases, the transistor switches back to its blocking mode, and the collapsing field around W1 induces a negative feedback signal in W3, as well as causing a reversal of current flow in W2. This negative feedback signal allows the capacitor C1 to discharge through R1 until the base of Q1 once again swings sufficiently positive to trigger Q1.

The ohmic values of resistors R1 and R2 are selected for optimum bias (e.g. 2.7 K and 15K, respectively); and capacitor C1 is selected to have minimal effect on frequency.

Figure 4:
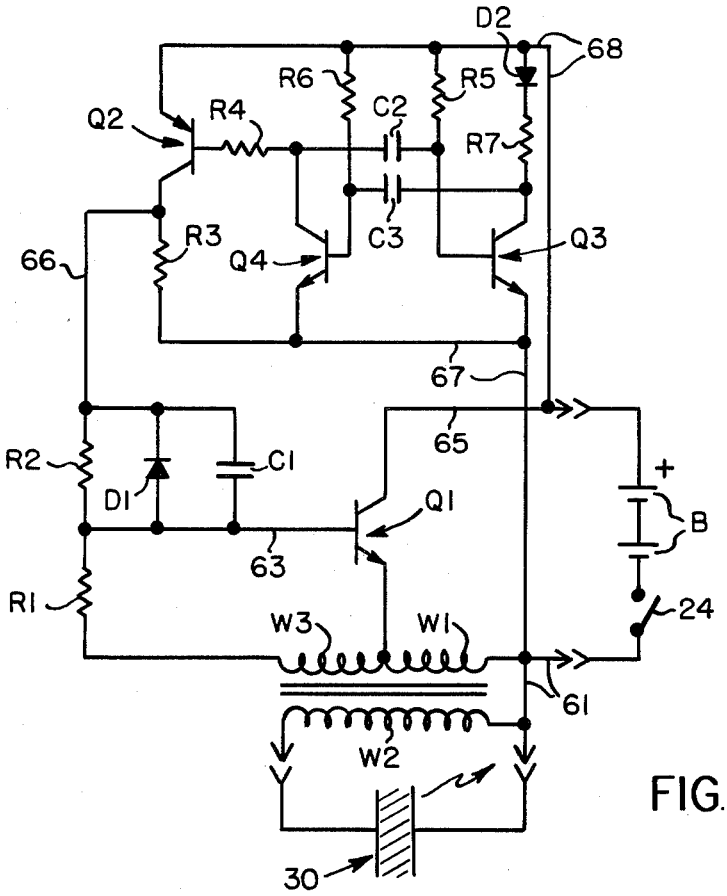
FIG. 4 is a schematic wiring diagram showing another form of this circuit for causing the EL lamp to flash on and off intermittently.

The circuit shown in FIG. 4, wherein like numerals are used to denote elements similar to those shown in FIG. 3, may be used if it is desired to have the lamp 30 flash intermittently when switch 24 is closed. The circuit is similar to that shown in FIG. 3 except that a multivibrator is connected in circuit with the primary winding W1, and the bias resistor R2 is not connected to the plate terminal of Q1 by conductor 62.

Instead, the positive terminal of battery B is connected to the collector of Q1 by a conductor 65, and R2, C1 and a diode D1 are connected in parallel between conductor 63 and one end of a conductor 66, the opposite end of which is connected to the collector of a switching transistor Q2, and through a resistor R3 and conductor 67 to conductor 61. The emitter of Q2 is connected by a conductor 68 to conductor 65; and the base of Q2 is connected through a resistor R4 and capacitor C2 to the base of a transistor Q3 that forms part of the multivibrator, and through a resistor R5 to conductor 68.

The collector of the other transistor Q4 of the multivibrator is connected between R4 and C2, and its emitter is connected to conductor 67. The base of Q4 is connected through a resistor R6 with conductor 68 and through a capacitor C3 to the collector of Q3. This collector terminal is also connected through a resistor R7 and diode D2 with conductor 68.

At the start, when switch 24 is closed, assuming Q4 conducts first, it blocks operation of Q3 and biases the base-emitter circuit of Q2 forwardly so that current flows in its emitter-collector circuit, and the battery B voltage is dropped across R3. At this stage the charging current for C1 flows through conductor 66 and the emitter-base circuit of Q1 (diode D1 at this time being reverse biased), thus causing conduction in the emitter-collector circuit of Q1. The EL lamp 30 thus begins to glow.

Assuming that approximately 1 second later C2 has charged sufficiently, it will bias the base-emitter circuit of Q3 forwardly causing it to fire and to discharge C3 and apply a reverse bias to Q4, which is therefore switched to its blocking mode. When the emitter-collector circuit of Q4 ceases to conduct, the voltage on its collector terminal rises and blocks Q2, thereby switching Q1 to its blocking mode, thereby turning off lamp 30. At this stage the diode D1 operates to allow positive feedback signals to bypass R2, thereby to prevent a positive signal from appearing on conductor 63 during the interval that Q3 is conducting (the "off" interval).

Shortly thereafter (for example after an interval of one second), assuming C3 has charged to the point where it biases the emitter-base circuit of Q4 forwardly, current once again begins to flow in the emitter-collector circuit of Q4, thereby turning on Q2 and switching Q3 to its blocking mode. Lamp 30 is thus once again illuminated for a 1 second interval. This cycle repeats until switch 24 is reopened.

From the foregoing it will be apparent that applicants' novel EL flashlight is capable of being operated intermittently, or steadily as in the case of a conventional flashlight. Moreover, the power for energizing lamp 30 may comprise one or more conventional flashlight batteries, or any other small, conventional DC power supply suitable for use in a conventional flashlight housing or the like. In the embodiment illustrated in FIG. 4, the R5 and R6, which preferably are identical (as are capacitors C2 and C3) are selected to provide a low current, slow speed multivibrator operation. The output of the converter circuit shown in FIGS. 3 and 4 produces an approximately sinusoidal, high voltage output signal for energizing lamp 30.

The layer 33 of electroluminescent material employed herein may be of any of the conventional types of E1 materials which, as noted above, become excited (and glow) when energized by the application of an intermittent signal across electrodes 32,35 from a signal source such as shown in FIGS. 3 or 4. Typical such EL materials are disclosed in U.S. Pat. Nos. 3,531,676; 3,571,674; and 3,786,307, all of which are owned by the assignee of the instant application.

While this invention has been illustrated and described in detail in connection with only certain preferred embodiments, it will be apparent that it is capable of further modification, and that this invention is intended to cover any such modifications thereof which fall within the scope of one skilled in the art, or the appended claims.

Having thus described our invention, what we claim is:

1. An electroluminescent flashlight, comprising a flashlight housing having thereon a manually-operable ON-OFF switch, and containing one or more flashlight batteries, a plane, flat, EL lamp comprising a layer of electroluminescent disposed between two electrodes, one of which is capable of transmitting light, means releasably mouting said lamp transversely across an opening in one end of said housing so said one electrode faces exteriorly of said housing, a control circuit removably mounted in said housing between said batteries and said lamp and operative, when said switch is in its ON position; to convert DC input from said batteries to AC output signals, and means for releasably connecting the output of said circuit to said electrodes to apply said AC signals thereacross, and thereby to cause said electroluminescent layer to produce a glowing light viewable from the exterior of said housing through said one electrode, said connecting means comprising two sets of spaced contacts releasably engageable with each other adjacent the center and the peripheral edge, respectively, of said lamp.

2. An electroluminescent lamp as defined in claim 1, wherein said circuit is potted in a second housing removably mounted in the first-named housing between said batteries and said lamp, said second housing has at the end thereof adjacent said lamp a peripheral flange which is seated between said one end of said housing and a marginal, peripheral portion of said lamp, and said mounting means comprises a generally annular cap releasably secured over said one end of said housing and against the marginal peripheral portion of said lamp remote from the peripheral flange on said second housing, whereby said lamp and said second housing are removably secured against movement in said housing by said cap.

3. An electroluminescent lamp as defined in claim 2 including a transparent lens interposed between said lamp and the central opening in said annular cap.

4. An electroluminescent lamp as defined in claim 2, wherein said second housing is metal and is generally bowl-shaped in configuration, and its rounded, closed end faces one end of one of said batteries.

5. An electroluminescent lamp as defined in claim 4, wherein said lamp is generally circular in configuration and registers coaxially with the peripheral flange on said second housing, and one of said sets of contacts includes a rivet secured in the peripheral portion of said lamp and having one end thereof connected to said one electrode and the other end thereof releasably engaged with the flange on said second housing.

6. An electroluminescent lamp as defined in claim 5, wherein the other set of contacts includes a resilient contact connected at one end to said circuit and projecting at its opposite end out of the open end of said second housing and resiliently into engagement with a metal surface positioned centrally on the back of said lamp and operatively connected to the other of said electrodes.

7. An electroluminescent lamp as defined in claim 1, wherein said control circuit comprises a transformer having a secondary winding connected across said electrodes, and a primary winding connected in an oscillator circuit, said oscillator circuit comprising a first transistor having its collector-emitter circuit connected in series with said primary winding across said batteries, having its base-emitter circuit connected in series with a portion of said primary winding and a first resistor to provide a feedback signal, and having a further resistor and a capacitor connected in parallel between the base of said first transistor and one side of the DC power supply formed by said batteries.

8. An electroluminescent lamp as defined in claim 7, including a switching transistor connected in the biasing circuit of said first transistor to allow the emitter-collector circuit of said first transister to oscillate only when the emitter-collector circuit of said switching transistor is conducting, and a multivibrator connected to the biasing circuit of said switching transistor thereby to cause the emitter-collector circuit of said switching transistor to conduct intermittently when said switch is in its ON position thereby to cause said EL lamp to flash on and off intermittently.

9. An electroluminescent lamp for use in a conventional flashlight housing, comprising a pair of thin, flat electrodes, a thin layer of dielectric material interposed between and electrically insulating said electrodes one from the other, a layer of electroluminescent material coating one surface of said layer of dielectric material and confronting one of said electrodes, a transparent plastic jacket surrounding and sealingly enclosing said electrodes and the layers of material interposed therebetween, a first, metal conductor having a first portion secured in said jacket in contact with one of said electrodes, and having a second portion extending exteriorly of said jacket for connection to one side of an AC power supply, and a second, metal conductor secured in said jacket and operatively connected electrically with the other of said electrodes, said jacket having in one side thereof an opening registering with a portion of said second conductor to permit connection of said second conductor through said opening in the jacket with the other side of said power supply.

10. An electroluminescent lamp as defined in claim 9, wherein a second layer of dielectric material is secured over the side of said other electrode remote from said one electrode, said second conductor comprises a layer of metal foil secured to the side of said second layer of dielectric material remote from said other electrode, and with a portion thereof registering with said opening in the jacket, and a third conductor is folded intermediate its ends in said jacket over the edge of said second layer of dielectric material with one end thereof in contact with said second conductor and the other end thereof in contact with said other electrode.

11. An electroluminescent lamp as defined in claim 10, wherein said second portion of said first conductor is folded inwardly over the outer edge of said jacket and beneath the head of a metal rivet which is secured in the marginal, peripheral portion of said jacket.

* * * * *